US005513549A

United States Patent [19]

Lewis

[11] Patent Number: 5,513,549

[45] Date of Patent: May 7, 1996

[54] MUSICAL INSTRUMENT MOUTHPIECE COVER HOLDER

[76] Inventor: Charles H. Lewis, 106 Kingswood Dr., Lafayette, La. 70501

[21] Appl. No.: 440,107

[22] Filed: May 12, 1995

[51] Int. Cl.[6] ..... G10D 9/02

[52] U.S. Cl. ..... 84/383 R; 84/387 A

[58] Field of Search ..... 84/383 R, 387 A, 84/398, 453

[56] References Cited

U.S. PATENT DOCUMENTS 4,991,483 2/1991 Petit ..... 84/383 R

*Primary Examiner*—Patrick J. Stanzione
*Attorney, Agent, or Firm*—William W. Stagg

[57] ABSTRACT

A mouthpiece cover holder to retain the mouthpiece of a musical instrument when the instrument is in use is comprised of a pair of retainers. The first retainer has a magnet surface on one side and an adhesive surface on the opposite side to attach the first retainer to the mouthpiece cover. The second retainer has an adhesive surface on one side to attach the second retainer to the musical instrument and a magnetically attractive surface on the opposite side to provide a surface to attract and retain the magnetic surface of the first retainer that has been attached to the mouthpiece.

11 Claims, 1 Drawing Sheet

MUSICAL INSTRUMENT MOUTHPIECE COVER HOLDER

FIELD OF INVENTION

The present invention generally relates to the field of musical instruments, and more particularly relates to a magnetic mouthpiece cover holder to retain the mouthpiece cover of a musical instrument, particularly a woodwind reed instrument such as a clarinet or saxophone, when the cover is not in use.

BACKGROUND OF INVENTION

In the field of musical instruments used in jazz, concert and marching bands, and in orchestras, particularly those woodwind instruments having reed mouthpieces such as clarinets and saxophones, it is common to provide a cover for the musical instrument mouthpiece. These mouthpiece covers protect the delicate components of the mouthpiece especially the reeds, from damage when the instrument is being handled. Covers also help to keep the mouthpiece clean when the instrument is not in use.

Presently, when the instrument is in use, there is no convenient way to store the mouthpiece cover. The covers are usually thrown back into the musical instrument case, placed in the pockets of the musician or placed on the music stand. This lack of a convenient storage place for the mouthpiece cover presents problems for the musician. When using the instruments for marching bands, or in concert or other show bands, uniform or costume pockets may not be available and instrument cases are typically left behind or back stage. The result is that the mouthpiece covers are not readily convenient when the instrument is not being used and the covers are often misplaced or lost. This results in damaged reeds which must be replaced at increased cost to the musician.

When the covers are left on the music stands used by orchestras, they often interfere with the sheet music and are often knocked to the floor. This may disrupt the musician and the performance. Consequently, a need exist for a convenient method to hold and retain a musical instrument mouthpiece cover so that the cover will be out of the musician's way yet remain readily available to the musician to cover the mouthpiece to protect it from dirt and damage when the instrument is not being used.

SUMMARY OF INVENTION

The present invention is designed to satisfy the aforementioned needs. Ideally, it is intended to be used with a musical woodwind instrument having a detachable mouthpiece cover. The musical instrument mouthpiece cover holder is comprised of a pair of retainers. The first retainer has a flat magnetic surface on one side and an adhesive surface on the other side for attachment to the mouthpiece cover. The second retainer has a flat magnetically attractive metal surface on one side and an adhesive surface on the other side for attachment to the musical instrument.

In use, the cover with first retainer attached is removed from the mouthpiece of the musical instrument and placed onto the second retainer attached to the instrument. The magnetic attraction between the magnetic plate and magnetically attractive surface retains the mouthpiece on the instrument and secures it in place. The mouthpiece cover retainer may also be used to magnetically attach the cover to a music stand. This may be done directly if the stand is metal or indirectly by using the adhesive backing of the second retainer to attach it to the music stand.

DESCRIPTION OF PREFERRED EMBODIMENT

Figure 1:
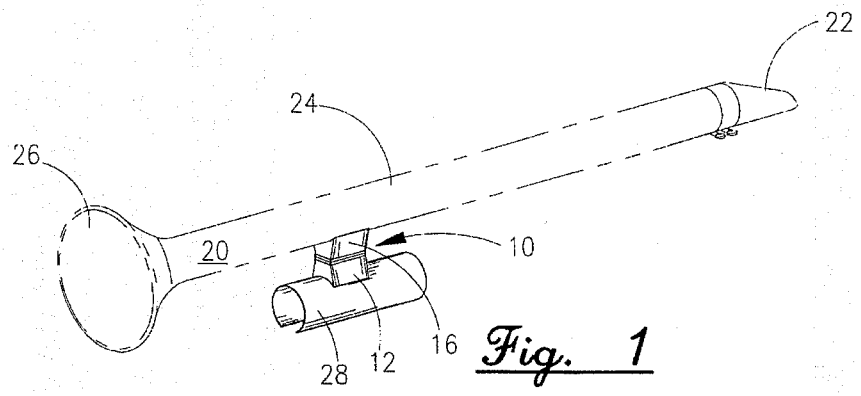
FIG. 1 is a perspective view of a musical instrument with the mouthpiece cover holder in place.

Referring now to the drawings, and more particularly to FIG. 1, there is shown the preferred embodiment of the mouthpiece holder apparatus generally designated 10 attached to a musical instrument 20, such as a clarinet, having a mouthpiece 22, a body 24 and a bell 26 and which utilizes a mouthpiece cover 28 to protect the mouthpiece 22. The holder 10 is comprised of a pair of opposing retainers. The first retainer 12 is comprised of a first retainer base 11. The base 11 has on one side an adhesive surface 13 curved or shaped to generally conform to the surface shape of the mouthpiece cover 28 and on the opposite side a magnet surface 14. Ideally, the magnet surface 14, is flat though other surface shapes may be utilized.

Similarly, the second retainer 16 has a second retainer base 15 with an adhesive surface 17 on one side which is curved or shaped generally to conform to the surface shape of the body 24 of the musical instrument 20 and on the opposite side, a magnetically attractive surface 18, such as a ferrous metal, which is shaped to conform generally to the magnet surface 14 on the first retainer 12. A number of commercially available adhesives may be utilized to form the retainer surfaces 13 and 17. The first and second retainers, 12 and 16, are preferably made of a light material such as plastic though other materials may be utilized.

Figure 2:
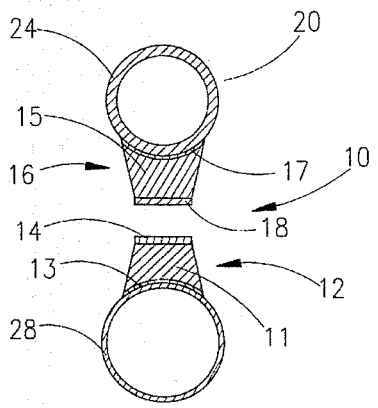
FIG. 2 is an exploded cross-sectional view showing the attachment of the mouthpiece retainer to a musical instrument.

To use the holder 10, as shown in FIG. 2, the adhesive surface 13 of the first retainer 12 is attached to the mouthpiece cover 28. The adhesive surface 17 of the second retainer 16 is attached to a convenient place on the body 24 of the instrument 20. When the mouthpiece cover 28 is removed from the mouthpiece 22, it may then be attached and held in place on the instrument by means of the magnetic attraction of the magnet surface 14 and the magnetically attractive surface 18 on retainers 12 and 16, respectively.

Figure 3:
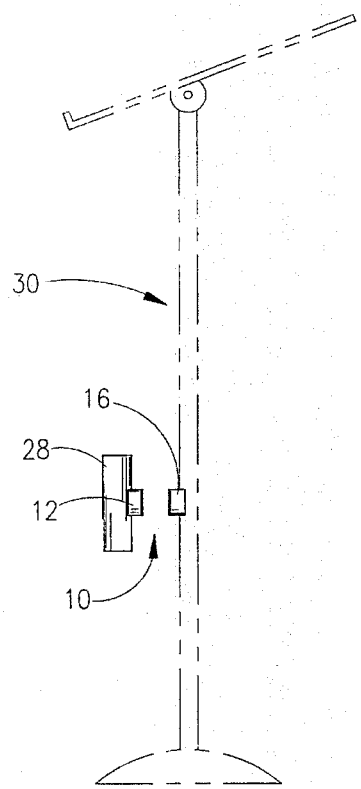
FIG. 3 is an elevational view of a music stand with mouthpiece cover holder.

The use of the retainer allows the musician a place to store the mouthpiece cover 28 when the instrument is in use and keeps the mouthpiece cover 28 readily available when the instrument is not in use. The magnet surface 14, when retainer 12 is adhesively affixed to the mouthpiece cover 28, may be used to attach the mouthpiece cover 28 to other metal surfaces such as to the top or underside of a metal music stand 30. The second retainer 16 may also attach to a convenient place on a music stand 30 for holding the mouthpiece cover 28 when it is attached to the first retainer 12, as shown in FIG. 3.

When used in this manner the magnetic surface 14, will keep the mouthpiece holder convenient for the musician and keep it from falling to the floor. Thus, the first retainer 12 can be used alone or in conjunction with retainer 16 as described.

Figure 4:
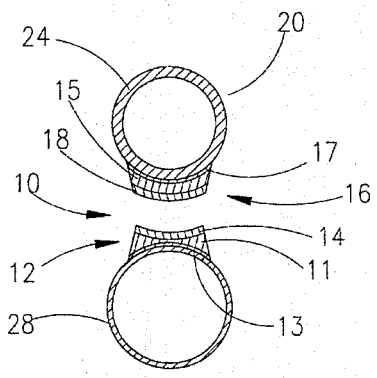
FIG. 4 is an exploded cross-sectional view showing an alternate embodiment of the mouthpiece holder showing its attachment to a musical instrument.

FIG. 4 is a cross-sectional view of an alternate embodiment of the mouthpiece holder apparatus 10. In the alternate embodiment, the base 15 of the second retainer 16 is a thin, flat flexible strip of plastic or other deformable material having an adhesive surface 17 on one side and a magnetic surface 18 on the opposite side. The flat, flexible base 15 allows the profile of the retainer 16 to conform to the body 24 of the instrument 20. The first retainer 12, which is mounted to the mouthpiece cover 28, has a convexly curved magnetically attractable surface 14 which conforms generally to the profile of the second retainer 16 when the second retainer 16 is mounted to the musical instrument 20.

It is thought that the mouthpiece cover holder and method of the present invention and many of its attendant advantages will be understood from the foregoing description and it will be apparent that various changes may be make in the form, construction and arrangement of the parts thereof without departing from the spirit and scope of the invention or sacrificing all of its material advantages, the form described herein being merely a preferred or exemplary embodiment of the invention.

I claim:

1. A mouthpiece cover holder to retain the mouthpiece of a musical instrument in a desired location when the instrument is in use, comprising:

a) a first retainer, said first retainer having an adhesive surface on one side for attaching said first retainer to said mouthpiece cover and a magnet surface on the opposite side; and b) a second retainer, said second retainer having an adhesive surface on one side for attaching said second retainer to said desired location and a magnetically attractive surface on the opposite side for attracting and holding said magnet surface of said first retainer to retain said mouthpiece cover when said first retainer is attached to said mouthpiece cover.

2. A mouthpiece cover holder as recited in claim 1 wherein, said magnet surface of said first retainer is flat.

3. A mouthpiece cover holder as recited in claim 2 wherein, said magnetically attractive surface of said second retainer is flat.

4. A mouthpiece cover holder as recited in claim 3 wherein, said adhesive surface of said first retainer is shaped to conform to the surface shape of said mouthpiece cover.

5. A mouthpiece cover holder as recited in claim 4 wherein, said adhesive surface is shaped to conform to the surface of said desired location.

6. A mouthpiece cover holder as recited in claim 1 wherein, the size and shape of said magnet surface on said first retainer conforms generally to the size and shape of the magnetically attractive surface on said second retainer.

7. A mouthpiece cover holder as recited in claim 1 wherein, said desired location is a musical instrument.

8. A mouthpiece cover holder as recited in claim 1 wherein, said desired location is a music stand.

9. A mouthpiece cover holder for retaining the mouthpiece cover of a musical instrument, such as a woodwind instrument, having a mouthpiece, a body and a bell comprising:

a) a first retainer having an adhesive surface on one side conforming to the surface shape of said mouthpiece cover for attaching said first retainer to said mouthpiece cover and a magnetic surface on the opposite side; and b) a second retainer having an adhesive surface on one side conforming to the surface shape of the body of said musical instrument for attaching said second retainer to said body of said musical instrument and a magnetically attractive surface on the opposite side conforming to size and shape of said magnetic surface of said first retainer for attracting and holding said magnetic surface of said first retainer to retain said mouthpiece cover when said first retainer is attached to said mouthpiece cover.

10. The mouthpiece cover holder as recited in claim 9 wherein, said first and second retainers are made of plastic.

11. The mouthpiece cover holder as recited in claim 9 wherein, said second retainer is a thin, flat, flexible strip conformable to the surface shape of said musical instrument.

* * * * *